US005121951A

United States Patent [19]

Harbom et al.

[11] Patent Number: 5,121,951

[45] Date of Patent: Jun. 16, 1992

[54] WINDOW FRAME DESIGN WITH CORRESPODING WINDOW LATCH & VENT SEALING DEVICE

[75] Inventors: John Harbom, Bolton; Allan Skjodt, Caledon East, both of Canada

[73] Assignee: Plastmo Ltd., Brampton, Canada

[21] Appl. No.: 680,881

[22] Filed: Apr. 5, 1991

[51] Int. Cl.[5] ..... E05D 15/22

[52] U.S. Cl. ..... 292/175; 49/175; 49/408; 292/DIG. 38

[58] Field of Search ..... 49/175, 408; 292/175, 292/153, 163, 147, DIG. 38

[56] References Cited

U.S. PATENT DOCUMENTS

| | | | |
|---|---|---|---|
| 2,103,989 | 12/1937 | Machinist | 292/153 X |
| 3,314,201 | 4/1967 | Riegelman | 49/408 X |
| 4,320,834 | 3/1982 | Tamaki | 292/175 X |
| 4,553,353 | 11/1985 | Simpson | 49/175 X |
| 4,791,756 | 12/1988 | Simpson | 49/175 |
| 4,924,628 | 5/1990 | Ruby et al. | 49/408 X |

*Primary Examiner*—Richard E. Moore
*Attorney, Agent, or Firm*—Arne I. Fors

[57] ABSTRACT

A window frame and sash combination having an exterior side and an interior side for providing pressure equilization between the window frame and sash on the exterior side thereof comprising a vent and drain channel extending along the inner perimeter of the window frame adjacent the exterior side of the sash, and a rectractable latch plate with detent arm on each side of the sash adjacent the window frame for latching the sash to the frame and for sealing the vent and drain channel.

13 Claims, 6 Drawing Sheets

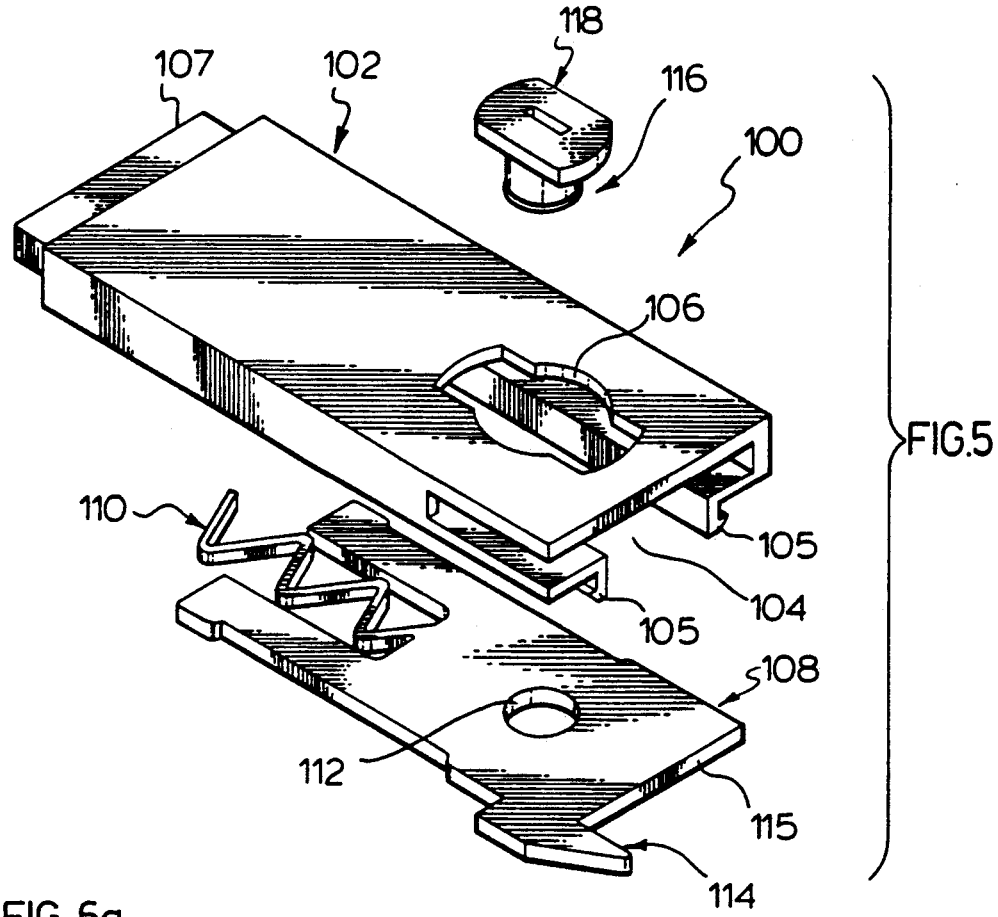
FIG.5
FIG. 6a.
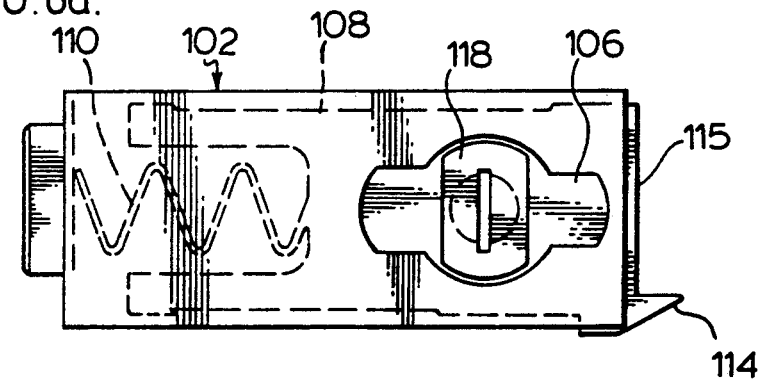
FIG. 6b.
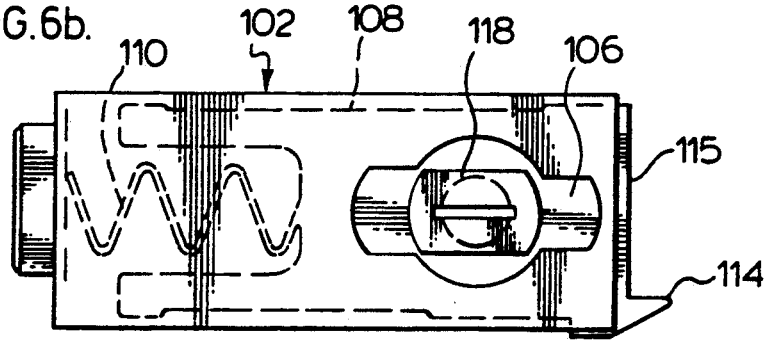

WINDOW FRAME DESIGN WITH CORRESPODING WINDOW LATCH & VENT SEALING DEVICE

BACKGROUND OF THE INVENTION

This invention relates to a novel window frame which provides for pressure equalization between window frame and window sash by means of a vent and drain channel extending along the perimeter of the window frame adjacent the sash and to a latch device which provides for opening means for the window while at the same time serving as a sealing device for the said vent and drain channel.

A recent development in window and glass panel doors has resulted in the construction of internal air vents along the sides of the window and door sash in communication with moisture vents at the sides of the sash to communicate exterior air with the interior of the sash and to equalize air pressure with the outside about the periphery of the window and glass panel doors. Such internal vent and drain channels minimize the collection of moisture and tend to equalize the air pressure in a designated channel in the window with the outside air pressure to allow any entrapped moisture or condensation to drain out through the bottom vents. A unique structure of this type is described in U.S. Pat. No. 5,044,121 issued Sep. 3, 1991.

In the case of a horizontally pivotable inside window sash, the present invention provides a mating sash and frame construction incorporating vertical and horizontal vent and drain channels which must be closed off to provide an adequate seal between the outside atmosphere and the inside of the house while, at the same time, allow the air pressure within the vertical and horizontal bottom vent and drain channels in the frame along the outer perimeter of the window sash to equalize with the outside air pressure.

It is therefore an object of this invention to provide a novel window frame with a vent and drain channel and a latching device at each side of the upper end of a horizontally pivotable sash to provide latching and sealing means for the vertical vent and drain channels when the window is closed.

It is an object of another aspect of this invention to provide a latching device for releasing the upper end of a pivotable sash to thereby horizontally pivot the sash on a lower axis.

It is an object of yet another aspect of this invention to provide a latching device for pivoting a sash at its lower end to facilitate the cleaning of the outside surface of the window pane mounted therein.

SUMMARY OF THE INVENTION

These and other objects of the invention are achieved by a window frame and sash combination having an exterior side and an interior side for providing pressure equalization between the window frame and sash on the exterior side thereof comprising a vent and drain channel extending along the inner perimeter of the window frame adjacent the exterior side of the sash, and sealing means formed on said sash adjacent the window frame for sealing said vent and drain channel when the sash is closed. The sealing means preferably function as latching and sealing means to secure the upper end of the sash to the frame and to close and seal the vent and drain channel when the sash is closed, said sealing means including a latching device mounted on the sash, said latching device comprising a housing secured to the sash, a latch plate reciprocally mounted within said housing, said latch plate having spring actuating means for biasing said plate in an extended latching position for engaging and closing said vent and drain channel, and latch actuating means for locking said latch plate in the extended latching position and for retracting the latch plate for releasing the window sash from the frame.

More particularly, the present invention, relates to a window frame and sash assembly with a vent and drain channel formed in the frame and a latching device on said sash for securing between the sash and frame of a window of the like comprising: a housing for mounting at each side at the top of a sash horizontally pivotable on a lower axis out of said frame; a latch plate with a spring actuating means within said housing for biasing said latch plate in an extended latching position; a latch actuating means including a display slot on said housing and a pin mounted on said latch plate and extending outwardly into said slot whereby said latch plate can be retracted into said housing from said latching position by directing a force on said pin contrary to said spring actuating means; and a detent arm extending from said latch plate on one side thereof and integral therewith, said detent arm adapted to extend across the vertical vent and drain channel extending along the side of the said frame to thereby transversely seal said channel and engage the frame when said plate is in a latching position.

BRIEF DESCRIPTION OF THE DRAWINGS

The latching device of the invention will now be described with reference to the accompanying drawings, in which;

FIG. 5 is an exploded perspective view of a latching device of the present invention;

FIG. 6*a* is a plan illustration of the latching device locked in a latching position;

FIG. 6*b* is a plan illustration of the device of FIG. 5*a* in an unlocked latching position preparatory to unlatching;

DESCRIPTION OF THE PREFERRED EMBODIMENT

Figure 1:
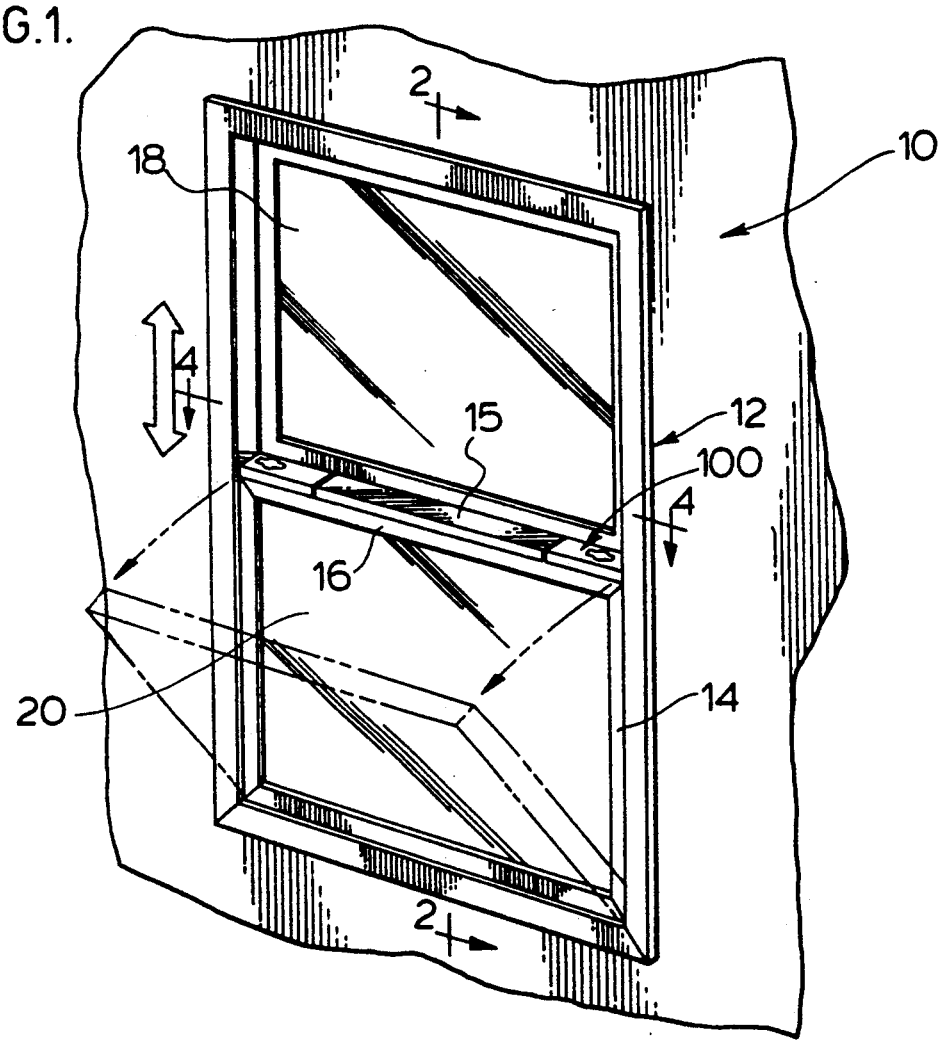
FIG. 1 is a perspective view of a window frame and sash assembly and a pair of latching devices of the present invention.

In FIG. 1, a window 10 having a frame 12 includes horizontally pivotable sash 14 which forms the lower inside portion of the window. Frame 12 and sash 14 are plastic extrusions. The top 16 of sash 14 includes a pair of latching devices 100 of the present invention, located at either end of meeting rail 15 and planar with the upper surface of rail 15.

These devices are located at opposite ends of top 16 and positioned on the corners of the sash 14 so that the leading edge of the respective latching device is engageable within vent and drain channels 24 formed along the window frame 12. The window includes an upper glass window pane 18 and a bottom glass window pane 20. Pane 18 may be incorporated into a sash 14 of same construction as the one incorporating pane 20.

Figure 2:
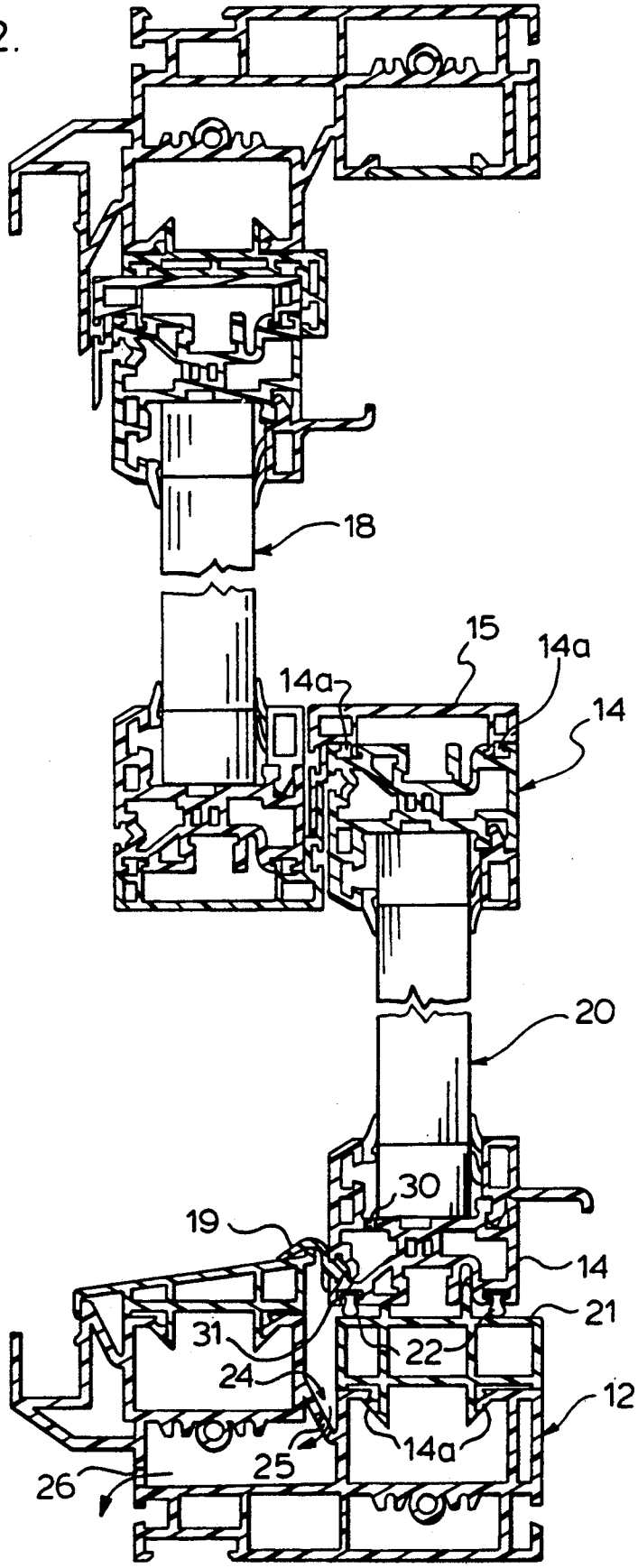
FIG. 2 is a vertical cross section of a window assembly illustrating the venting and draining means being part of the present invention.

In FIG. 2, a window of the type shown in FIG. 1 is illustrated in vertical cross section to indicate the air and moisture venting arrangements. In this view, the sash 14 with pane 20 is shown mounted in frame 12 and includes sealing gaskets 22 at the bottom of sash 14 for providing an effective air seal with opposed surface 21 of the frame at the bottom of the window, and rain screen gasket 19. The groove 24 serves as a vent and drain channel which is connected to the exterior through openings 25 and 26, thus maintaining the same air pressure in the channel 24 as the atmospheric pressure external to the window while allowing any water which may penetrate into this channel to drain out freely. Furthermore the opening connects the vent and drain channel 24 to the cavity in the sash which holds the glass panel 20, thus allowing pressure equalization with the exterior and good drainage of this cavity through holes 30, 31.

Figure 3:
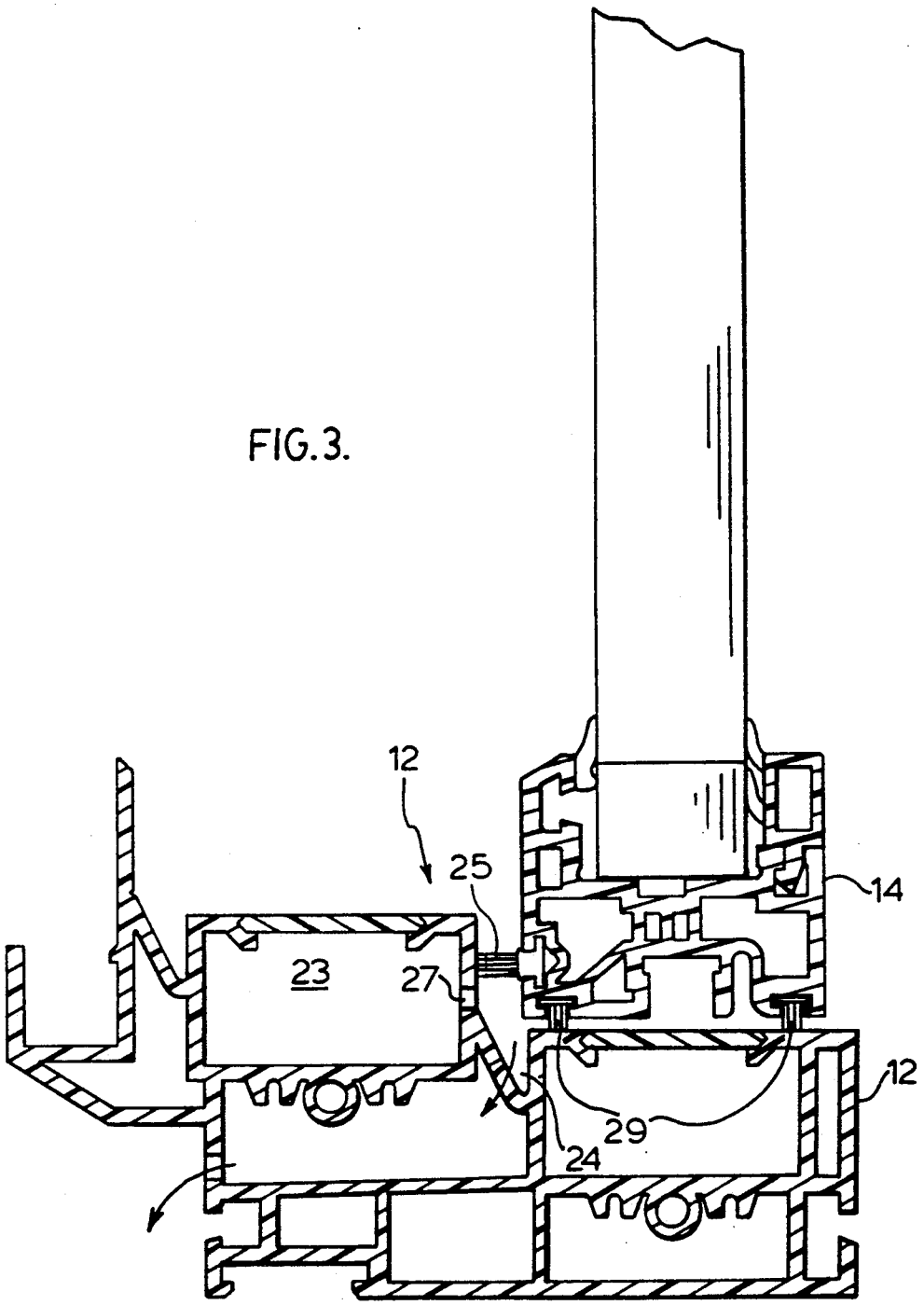
FIG. 3 is a horizontal cross section illustrating the venting and draining means being part of the present invention.

FIG. 3 is a horizontal cross-section of one side of a window sash of the type shown in FIG. 1. It can be seen how the vent and drain channel 24 extends vertically between frame 12 and sash 14 adjacent the exterior of the sash. Elongated seal 25 mounted on sash 14 provides a continuous sliding seal against the surface of frame 12 for an effective rainscreen.

One or more openings 27 allows outside air into channel 24 from cavity 23, which is open to the atmosphere, for better pressure equalization between the exterior and channel 24. Vertical seals 29 connect to horizontal seals and vertical seal 25 connects to gasket 19

Figure 4:
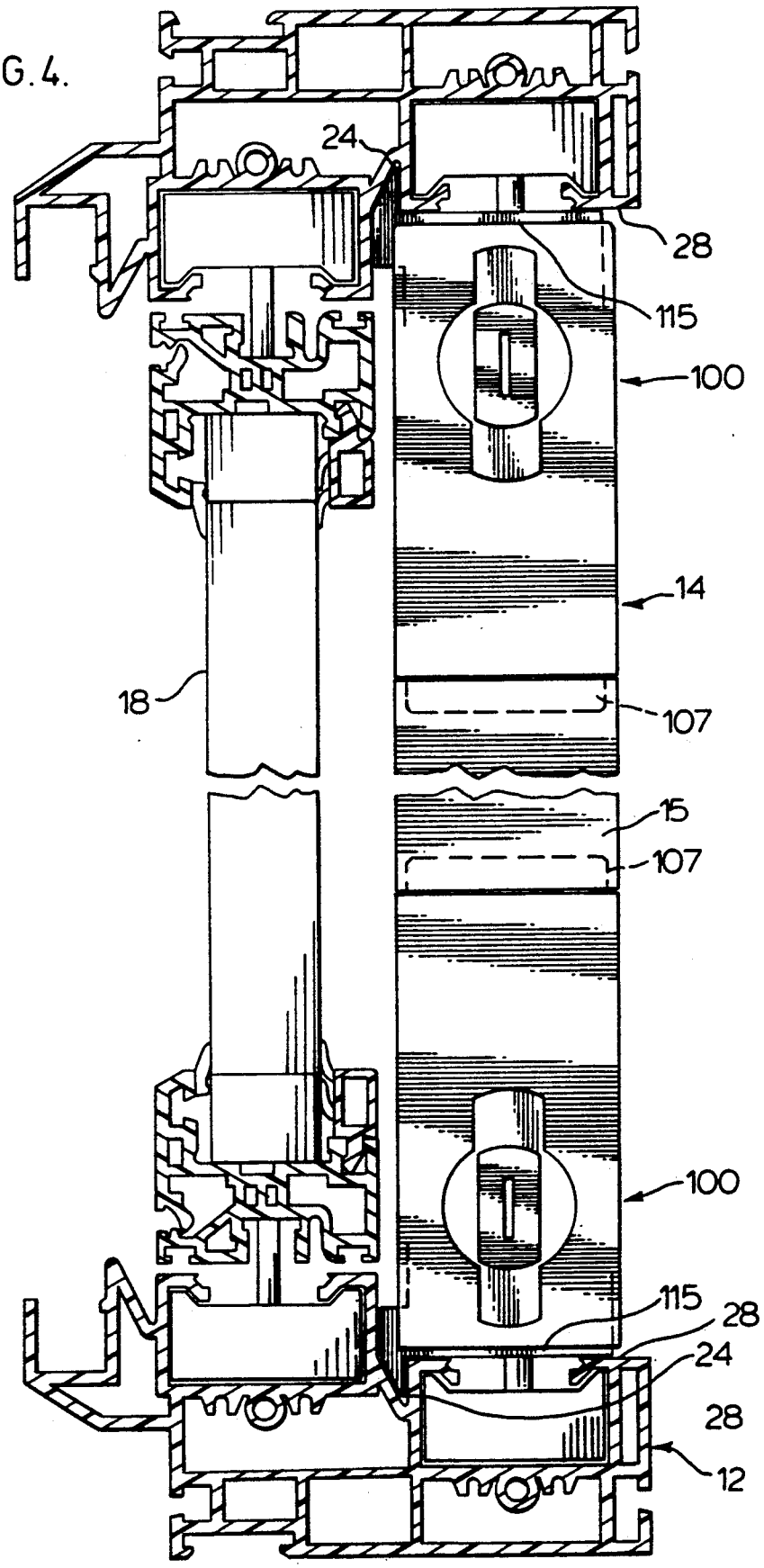
FIG. 4 is a horizontal cross-section, partly in plan, of a window assembly illustrating the latching devices operative for sealing the vertical vents and drain channel.

In FIG. 4, a plan cross-section taken through the area of upper window pane 18 shows the vertical vent and drain channels 24 on either side of the bottom window sash 14 extending up beyond the top of window sash 14. The latching devices 100 are mounted on either end of meeting rail 15 on top of sash 16 and are shown in the closed position in which the vent and drain channels 24 are sealed from contact with the inside room and the window sash 14 is secured in place at the upper end.

FIG. 5 shows the various elements of the latching device of the invention. Latching device 100 includes a housing 102 having a slot opening 104 at one end and a display slot 106 at the top thereof. A latching plate 108 longitudinally slidable in opening 104 includes a compression spring 110 at its inner end, a centrally located opening 112, and a detent arm 114 on the side of its outer leading edge 115. The detent arm is so constructed and configured as to fit across into and close the vertical vent and drain channel passage 24 of the window in a manner to be explained below. The leading edge 115 will abut the opposed surface 28 of the frame when the arm 114 is extended into the vent and drain channel 24, thus forming a horizontal top seal over vertical seals 29 shown in FIG. 3.

A latching pin 116 having an actuating head 118 is shown spaced from the top of a housing 102. Actuating head 118 is scored for receiving a screw driver, edge of a coin or other tool for rotating the pin when in display slot 106.

The bottom or mounting side of housing 102 includes a pair of engaging rail clips 105 and an end alignment lip 107 for securing the device onto the top 16 of window sash 14, and into rail 15. The housing is thus secured onto sash 14 by snapping rail clips 105 into the sash retaining shoulders **14*a* shown in FIG. 2 and sliding the housing into engagement with rail 15. The meeting rail 15 provides a continuous planar upper surface between the upper surfaces of latching devices 100**.

When assembled, the device 102 has latching plate 108 slidably mounted within opening 104 so that the plate's central opening 112 is aligned substantially in the centre of display slot 106. Compression spring 100 biases plate 108 outwardly to the right, as viewed in FIGS. **6*a*–7. Latching pin 116 is inserted into display slot 106 so that the pin portion fits into central opening 112 of plate 108** for rotation therein.

In FIG. **6*a*, the assembled device is shown wherein the latching plate 108 is in the extended latching position with detent arm 114 extended outwardly to secure the upper end of the window sash 14 in vertical channel 24 and close said channel when the window sash is closed. The device is so constructed that latching pin 116 is substantially centrally located in display slot 106 when the plate is in the latching position. Display slot 106 is centrally contoured so that head 118 of latching pin 116 can be rotated in the central opening of the latching plate 108 until pin actuating head 118** is nested into the central contour. In this position, the latching plate is substantially locked into the extended locking position and the latch cannot be inadvertently disengaged, precluding accidental inward pivoting of the inside window sash.

Figure 6C:
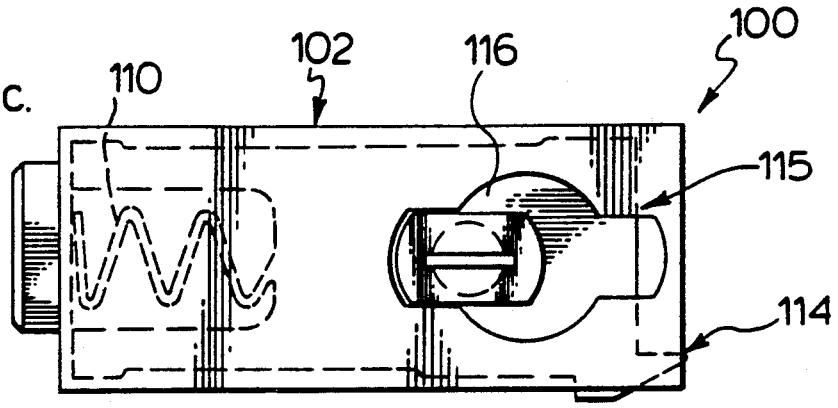
FIG. 6*c* is a plan illustration of the device with the latching plate retracted from the latching position.

In FIG. **6*b*, the device 100 is shown in the extended latching position as in FIG. 6*a*, but the actuating head 118 is aligned outside of the centrally contoured area of display slot 106**, so that the latching plate is ready to be disengaged.

FIG. **6*c* shows latching device 100 substantially as shown in FIG. 6*b* but with the latching plate retracted into housing 102 in the disconnect position. The latching plate 108 and spring 110 are shown in broken outline as they are contained within housing 102. In this disconnect position, latching pin 116 is retracted to the left by hand against the force of compression spring 110 so that detent arm 114 and the leading edge 115 are drawn inside the casing and consequently are moved away from the vertical vent and drain channels 24** of the window frame.

When the latching device on each side of the top of the sash is so withdrawn, the sash can be freely pivoted inwardly about its lower end so that the outer face of window pane 20 can be easily cleaned.

Figure 7:
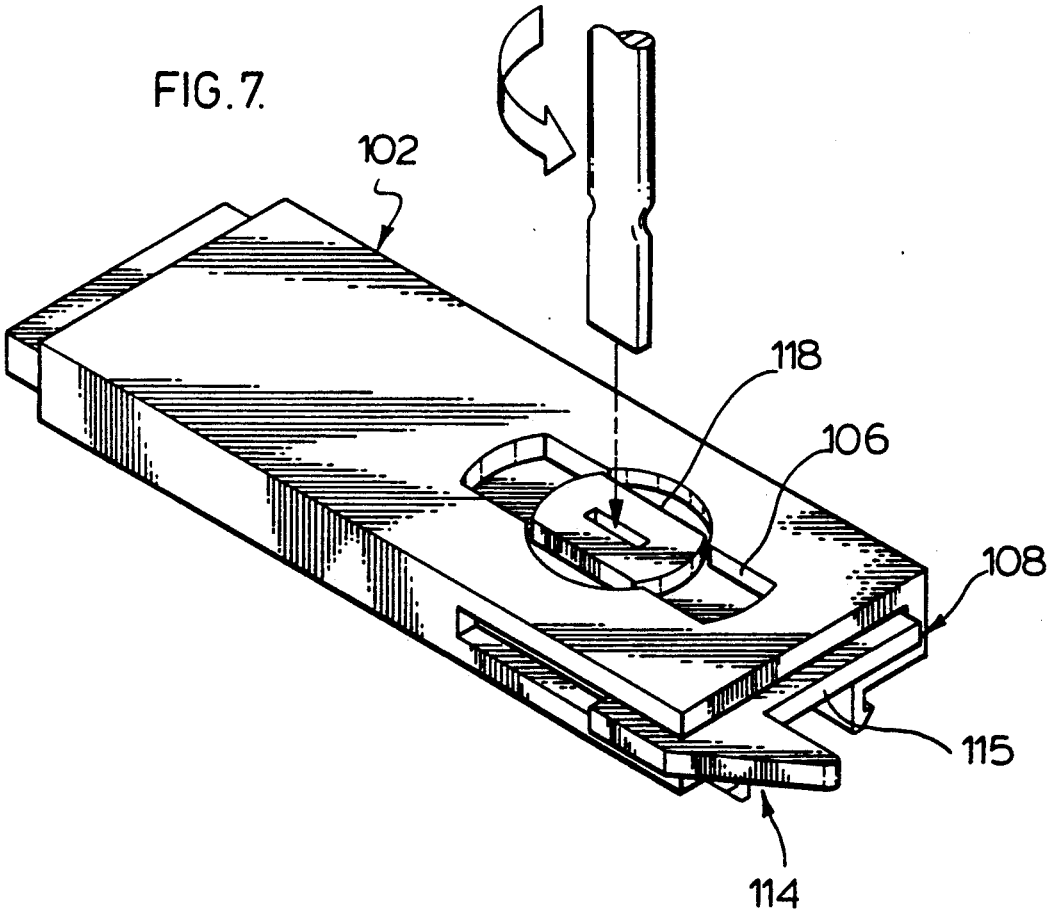
FIG. 7 is a perspective view of the latching device illustrating the cooperation of a tool with the latch actuating means.

FIG. 7 illustrates the latching device 100 with a screw driver tip aligned for engagement within an accommodating indentation on the actuating head surface. With the latching plate, detent arm and pin aligned in the latching position, the screw driver tip can be rotated 90 degrees to align head 118 in the locking zone of slot 106 to prevent accidental disengagement of the latch.

While an attempt has been made to fully describe the invention, it will be understood that obvious modifications can be made in the applicant's device without departing from the invention as particularly described above or as set out in the accompany claims.

We claim:

1. A window frame and sash combination having an exterior side and an interior side for providing pressure equalization between the window frame and sash on the exterior side thereof comprising a vent and drain channel extending along the perimeter of the window frame adjacent the exterior side of the sash, and sealing means formed on said sash adjacent the window frame for sealing said vent and drain channel from the interior side of the window frame and sash combination when the sash is closed.

2. A window frame and sash combination as claimed in claim 1 in which said sealing means includes a latching device mounted on the sash, said latching device comprising a housing secured to the sash, a latch plate reciprocally mounted within said housing, said latch plate having spring, actuating means for biasing said plate in an extended latching position for engaging and closing said vent and drain channel, and latch actuating means for locking said latch plate in the extended latching position and for retracting the latch plate for releasing the window sash from the frame.

3. A window frame and sash assembly with a vent and drain channel formed in the frame and a latching device on said sash for securing between the sash and frame of a window of the like comprising: a housing for mounting at each side at the top of a sash horizontally pivotable on a lower axis out of said frame; a latch plate with a spring actuating means within said housing for biasing said latch plate in an extended latching position; a latch actuating means including a display slot on said housing and a pin mounted on said latch plate and extending outwardly into said slot whereby said latch plate can be retracted into said housing from said latching position by directing a force on said pin contrary to said spring actuating means; and a detent arm extending from said latch plate on one side thereof and integral therewith, said detent arm adapted to extend across the vertical vent and drain channel extending along the side of the said frame to thereby transversely seal said channel and engage the frame when said plate is in a latching position.

4. A device as claimed in claim 3 wherein said spring actuating means is a compression spring axially secured between the latching plate and the end of said casing remote from said abuting end.

5. A device as claimed in claim 4 wherein said compression spring is of a resilient material integral with said latching plate.

6. A device as claimed in claim 5 wherein said pin is perpendicularly mounted on said latching plate and rotatable thereon, said pin including a head having a tool engaging surface for the axial rotation of said pin.

7. A device as claimed in claim 6 wherein the display slot of said latch actuating means has a central locking zone whereby said latching plate can be locked in forward latching position by the substantially 90 degree rotation of said pin within said zone.

8. A device as claimed in claim 3 wherein said detent arm has a leading edge having a shape which conforms with the shape of the frame to provide a seal against the frame when the latch plate is in an extended latching position.

9. A latching device for securing a window sash or the like to a frame comprising a housing for mounting at each side at the top of a sash horizontally pivotable on a lower axis out of said frame; a latch plate with a spring actuating means within said housing for biasing said latch plate in an extended latching position; a latch actuating means including a display slot on said housing and a pin mounted on said latch plate and extending outwardly into said slot whereby said latch plate can be retracted into said housing from said latching position by directing a force on said pin contrary to said spring actuating means; and a detent arm extending from said latch plate on one side thereof and integral therewith, said detent arm adapted to extend across the vertical vent and drain channel extending along the side of the said frame to thereby transversely seal said channel and engage the frame when said plate is in a latching position.

10. A device as claimed in claim 9 wherein said spring actuating means is a compression spring axially secured between the latching plate and the end of said casing remote from said abuting end.

11. A device as claimed in claim 10 wherein said compression spring is of a resilient material integral with said latching plate.

12. A device as claimed in claim 11 wherein said pin is perpendicularly mounted on said latching plate and rotatable thereon, said pin including a head having a tool engaging surface for the axial rotation of said pin.

13. A device as claimed in claim 12 wherein the display slot of said latch actuating means has a central locking zone whereby said latching plate can be locked in forward latching position by the substantially 90 degree rotation of said pin within said zone.

* * * * *